United States Patent [19]

Choiniere et al.

[11] Patent Number: 4,895,528

[45] Date of Patent: Jan. 23, 1990

[54] UNIVERSAL HIGH/LOW VOLTAGE HOSE-TO-WALL FITTING FOR CURRENT-CARRYING FLEXIBLE HOSE

[75] Inventors: Alcide W. Choiniere; George T. Dunn, Jr., both of Abbeville, S.C.

[73] Assignee: Automation Industries, Inc., Greenwood, S.C.

[21] Appl. No.: 283,565

[22] Filed: Dec. 13, 1988

[51] Int. Cl.[4] ..... H01R 4/60

[52] U.S. Cl. ..... 439/191; 439/171

[58] Field of Search ..... 439/190, 191, 192, 193, 439/194, 195, 52, 166, 170, 171, 172, 173, 174, 175; 15/22 R, 314, 361; 174/47; 200/61.6; 285/7

[56] References Cited

U.S. PATENT DOCUMENTS

| | | | |
|---|---|---|---|
| 2,957,156 | 10/1960 | Gatto et al. | 439/166 |
| 3,034,085 | 5/1962 | Pauler et al. | 439/191 |
| 4,188,081 | 2/1980 | Holden et al. | 439/192 |
| 4,758,170 | 7/1988 | Hayden | 439/142 |

*Primary Examiner*—Neil Abrams
*Assistant Examiner*—Khiem Nguyen
*Attorney, Agent, or Firm*—Francis N. Carten

[57] ABSTRACT

A hose-to-wall fitting for attachment to one end of a current-carrying flexible hose to enable such hose to be connected through a wall-mounted current-carrying inlet valve to both (1) a source of vacuum and (2) dual sources of electrical power, e.g., a high-voltage source for powering a motor or the like, and a low-voltage source for powering a control circuit or the like through a switch built into the handle/wand fitting attached to the other end of the hose. The high-voltage male contacts of the hose-to-wall fitting can be reversed to enable use with the types of inlet valves which incorporate only the connections to the source of vacuum and to the low voltage source, or only the connection to the source of vacuum, the high-voltage connection being made in either case through a short electrical cord to a conventional electrical outlet.

20 Claims, 3 Drawing Sheets

UNIVERSAL HIGH/LOW VOLTAGE HOSE-TO-WALL FITTING FOR CURRENT-CARRYING FLEXIBLE HOSE

SUMMARY OF THE INVENTION

The present invention is embodied in a hose-to-wall fitting for attachment to one end of a current-carrying flexible hose in order to enable such hose to be connected through a wall-mounted current-carrying inlet valve to: (1) a source of vacuum; (2) a first source of electrical power, e.g., a high-voltage source for powering a motor or the like; and (3) a second source of electrical power, e.g., a low-voltage source for powering a control circuit or the like through a switch built into the handle/wand fitting attached to the other end of the hose. The hose-to-wall fitting can be used with several different types of inlet valves currently available for use in central vacuum cleaning systems: (1) with an inlet valve which incorporates the connections to the source of vacuum and to both sources of electrical power; after the reversal of the position of the high-voltage male contacts and the connection thereto of a short electrical cord, (2) with an inlet valve which incorporates only the connections to the source of vacuum and to the low voltage source of electrical power, the high-voltage connection being made through the short electrical cord to a conventional electrical outlet; (3) with an inlet valve which incorporates only the connection to the source of vacuum, the high-voltage connection again being made through the short electrical cord to a conventional electrical outlet; and, after replacement of the high-voltage male plug with an L-shaped closure member for providing a smooth external surface, (4) with an inlet valve which incorporates both the connections to a source of vacuum and to a low voltage source of electrical power.

DESCRIPTION OF THE DRAWINGS

The written description of the present invention will be more fully understood when read with reference to the accompanying drawings, of which.

DETAILED DESCRIPTION OF THE PREFERRED EMBODIMENT

Figure 1:
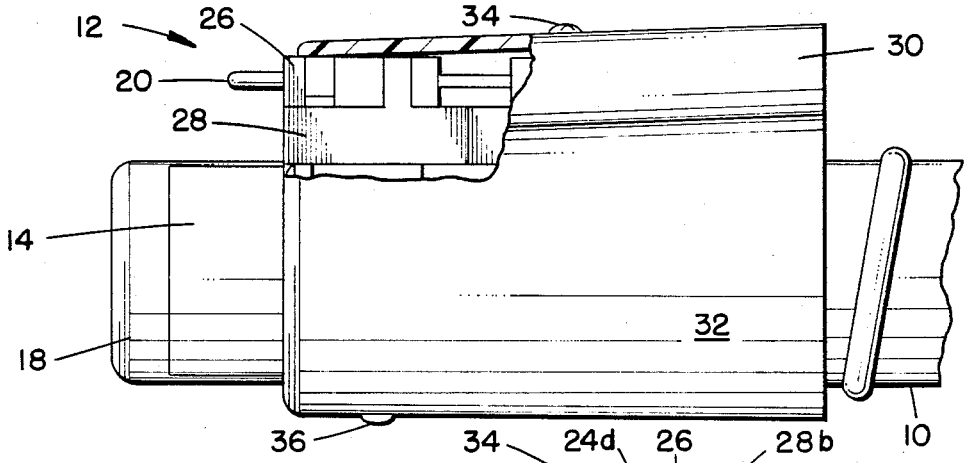
FIG. 1 is a partially broken-away side elevation of applicants' hose-to-wall fitting shown connected to one end of a length of current-carrying flexible hose, with the high-voltage electrical contacts oriented for use with the first type of inlet valve referred to above.
Figure 2:
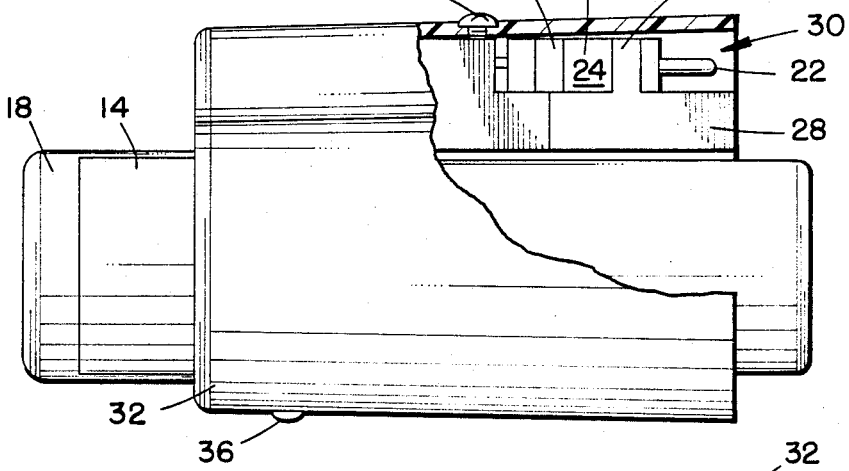
FIG. 2 is a partially broken-away side elevation of applicants' hose-to-wall fitting, with the high-voltage electrical contacts oriented for use with the second or third types of inlet valve referred to above.
Figure 3:
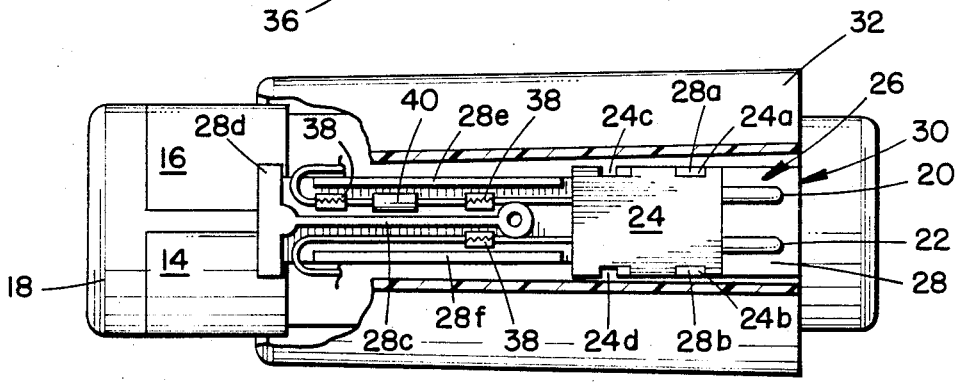
FIG. 3 is a partially broken-away top elevation of the hose-to-wall fitting shown in FIG. 2.
Figure 4:
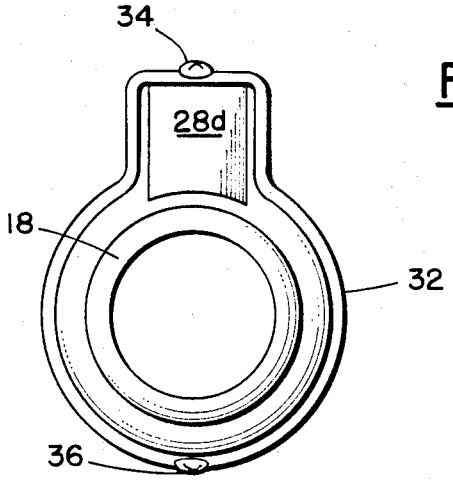
FIG. 4 is a front (wall end) elevation of the hose-to-wall fitting shown in FIG. 2.
Figure 5:
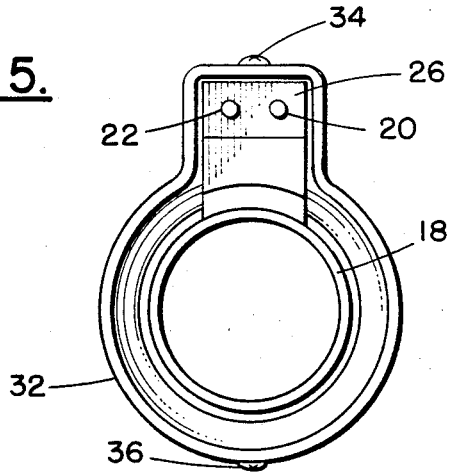
FIG. 5 is a back (hose end) elevation of the hose-to-wall fitting shown in FIG. 2.
Figure 6:
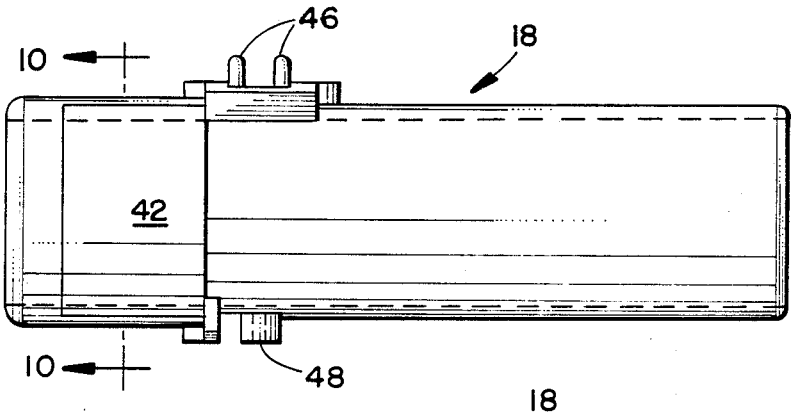
FIG. 6 is a side elevation of the inner sleeve of the hose-to-wall fitting shown in FIGS. 1 and 2.
Figure 7:
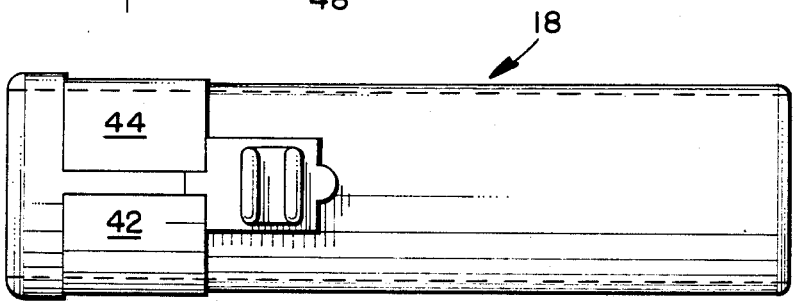
FIG. 7 is a top elevation of the inner/sleeve of the hose-to-wall fitting shown in FIGS. 1 and 2.
Figure 8:
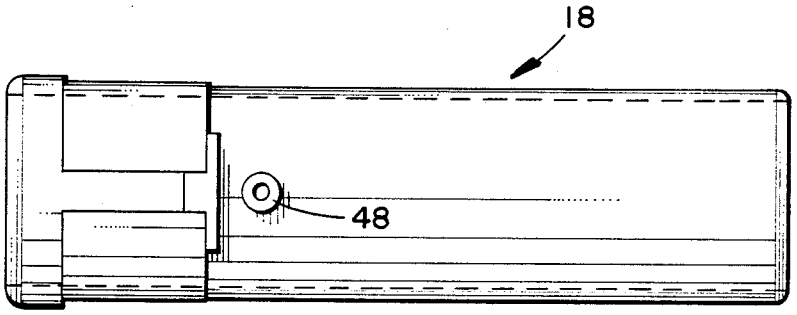
FIG. 8 is a bottom elevation of the inner sleeve of the hose-to-wall fitting shown in FIGS. 1 and 2.
Figure 9:
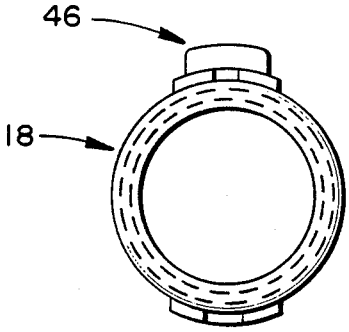
FIG. 9 is a front (wall end) elevation of the inner sleeve of the hose-to-wall fitting shown in FIGS. 1 and 2.
Figure 10:
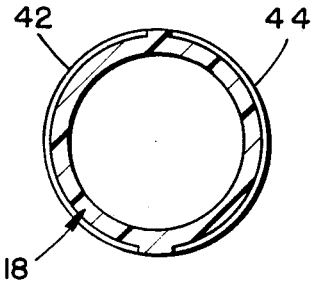
FIG. 10 is a sectional view of the inner sleeve of the hose-to-wall fitting shown in FIGS. 1 and 2 taken through section line 10—10 in FIG. 6.

Referring now specifically to FIG. 1, the hose 10 is preferably of the dual support wire type disclosed (FIGS. 1–2) and claimed in U.S. Pat. No. 4,693,324 (Choiniere and Dunn), the disclosure of which is hereby incorporated by reference. The hose-to-wall fitting 12 is most advantageously used in conjunction with the current-carrying inlet valve disclosed and claimed in U.S. Pat. No. 4,758,170 (Hayden), although it may be used with virtually any other type of inlet valve for a central vacuum system. Applicants' hose-to-wall fitting 12, configured as shown in FIG. 1, enables a user to simultaneously establish connections to a source of vacuum, to a low-voltage source of electrical power, and to a high-voltage source of electrical power with a single motion, viz., insertion of the wall end of the fitting 12 into an inlet valve of the type disclosed and claimed in U.S. Pat. No. 4,758,70 (Hayden). This is achieved by positioning a pair of low-voltage electrical tab contacts 14, 16 (the latter being hidden in FIG. 1) circumferentially about the wall end of the hollow inner sleeve 18 through which the vacuum connection is made, and a pair of high-voltage electrical pin contacts 20, 22 (the latter being hidden in FIG. 1) away from the inner sleeve 18. The low-voltage tab contacts 14, 16 are secured in place by cementing them into shallow recesses in the inner sleeve 18, with their outer surfaces flush with the outer surface of inner sleeve 18. The high-voltage pin contacts 20, 22 are secured within an insulating member 24 to form a male plug 26, which is in turn secured in a holder 28 which is housed in a chamber 30 formed in outer cover 32, the holder 28 being secured therein by a screw 34. The outer cover 32 is secured to the inner sleeve 18 by another screw 36, and the low- and high- voltage current-carrying wires extending from the end of hose 10 are connected by conventional means such as aluminum tape, autosplices and wire leads to the low- and high-voltage contacts 14, 16 and 20, 22, respectively, within the fitting 12. The end of hose 10 extends into the annular space between the inner sleeve 18 and the outer cover 32, and is secured to the outer surface of a portion of inner sleeve 18 by a suitable cement.

Referring now to FIGS. 2, 3, 4 and 5, an alternative configuration of applicants' hose-to-wall fitting 12 is shown. This configuration enables the fitting 12 to be used with inlet valves of earlier design, i.e., inlet valves without means for connection to a source of high-voltage electrical power. The difference between this configuration and that shown in FIG. 1 is that the male plug now extends toward the hose end of the fitting 12 rather than toward the wall end of the fitting 12 as in FIG. 1, and the high-voltage pin contacts 20, 22 are completely within the chamber 30 rather than extending completely beyond the chamber 30 as in FIG. 1. This is accomplished by reversing the orientation of the holder 28 on the inner sleeve 18 as compared to its orientation in FIG. 1; moving the male plug 26 relative to the holder 28 by lifting it out so that the retaining members 28*a*, 28*b* of holder 28 are removed from slots 24*c*, 24*d* of the insulating member 24; replacing the male plug 26 by inserting the retaining members 28*a*, 28*b* of holder 28 into slots 24*a*, 24*b* of the insulating member 24; making the necessary electrical connections by any convenient means such as the autosplices 38; and sliding the outer cover 32 over the sleeve-plug-holder subassembly and inserting screws 34, 36. Because the holder 28 is sized and positioned to fit completely within the chamber 30 regardless of which orientation the holder 28 is given, the male plug 26 is now shifted inward with respect to the mouth of the hose end of the chamber 30 for the protection of the pin contacts 20, 22 and for engagement of those pin contacts 20, 22 with receptacle contacts in a female plug attached to one end of a short length of electrical cord to be connected at its other end to a source of high-voltage electrical power. Devices such as fuse 40 and the like may be enclosed between the outer walls 28*e*, 28*f* and the central wall 28*c* of holder 28.

Referring now to FIGS. 6, 7, 8, 9 and 10, the inner sleeve 18 is shown to include recesses 42, 44 for receiving the low-voltage tab contacts 14, 16 described above. A pair of mounting members 46 serves to engage an opening in the underside of holder 28 to aid in the process of assembling the hose-to-wall fitting 12. A tap hole 48 is provided for screw 36.

Figure 12:
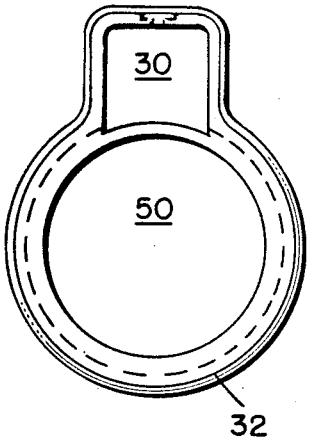
FIG. 12 is a front (wall end) elevation of the outer cover of the hose-to-wall fitting shown in FIGS. 1 and 2.
Figure 11:
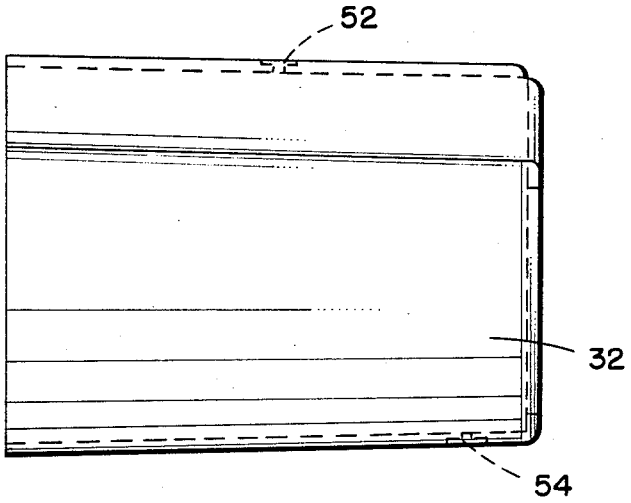
FIG. 11 is a side elevation of the outer cover of the hose-to-wall fitting shown in FIGS. 1 and 2.
Figure 13:
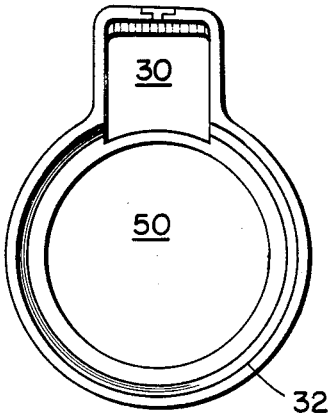
FIG. 13 is a back (hose end) elevation of the outer cover of the hose-to-wall fitting shown in FIGS. 1 and 2.
Figure 14:
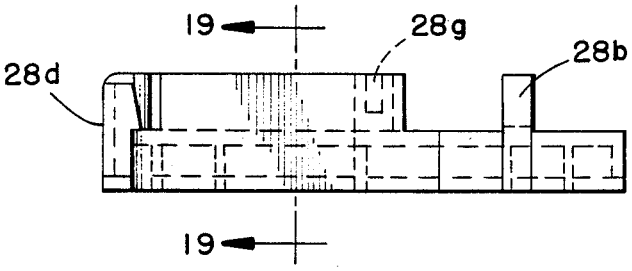
FIG. 14 is a side elevation of the plug and fuse holder which is reversibly fittable in the chamber formed in the outer cover of the hose-to-wall fitting shown in FIGS. 11–13.
Figure 17:
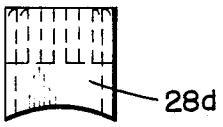
FIG. 17 is a front elevation of the plug and fuse holder shown in FIG. 14.
Figure 15:
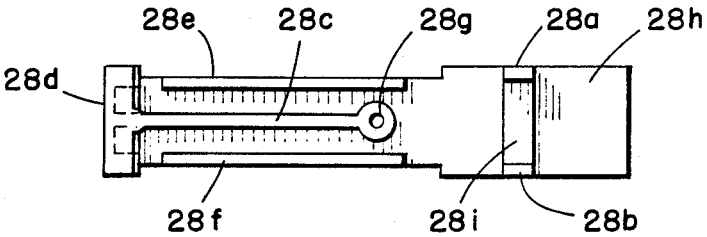
FIG. 15 is a top elevation of the plug and fuse holder shown in FIG. 14.
Figure 18:
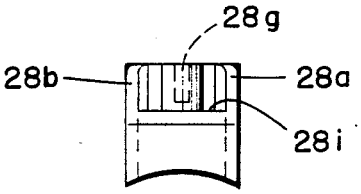
FIG. 18 is a back elevation of the plug and fuse holder shown in FIG. 14.
Figure 16:
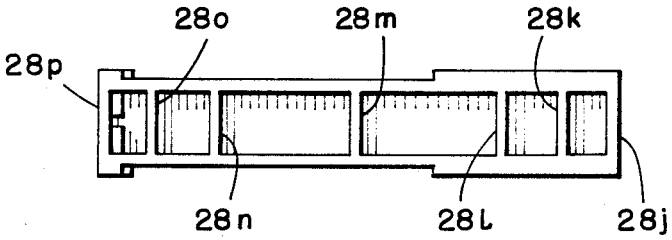
FIG. 16 is a bottom elevation of the plug and fuse holder shown in FIG. 14.
Figure 19:
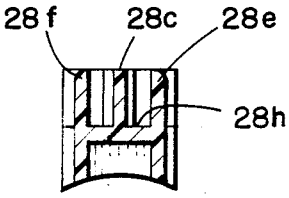
FIG. 19 is a sectional view of the plug and fuse holder shown in FIG. 14 taken through section line 19—19 in FIG. 14.

Referring now to FIGS. 11, 12 and 13, the outer cover 32 is shown to define chamber 30 as well as the larger cylindrical passage 50 through which the inner sleeve 18 is passed during assembly. Countersunk holes 52 and 54 are provided for screws 34 and 36 so that the screwheads will be nearly flush with the surrounding surfaces of outer cover 32.

Referring now to FIGS. 14, 15, 16, 17, 18 and 19, holder 28 is shown to include the vertical retaining members 28*a*, 28*b*; central wall 28*c*; end wall 28*d*; outer walls 28*e*, 28*f*; tap hole 28*g*; and floor 28*h*. The ends of the outer walls 28*e*, 28*f* adjacent the end wall 28*d* do not join therewith so as to leave space for the passage of wires from the hose 10 into the compartments formed by the outer walls 28*e*, 28*f* and the central wall 28*c*. Between the vertical retaining members 28*a*, 28*b* and extending upwardly from the floor 28*h* is a bar 28*i* for engagement with one of two correspondingly-sized horizontal slots positioned on the underside of the insulting member 24 of male plug 26, one such slot extending between the first pair of vertical slots 24*a*, 24*b* and the second such slot extending between the second pair of vertical slots 24*c*, 24*d*. The bottom edges of the bracing walls 28–28*p* below the floor 28*h* are curved to fit against the outer surface of inner sleeve 18. The space between the bracing walls 28*k*, 28*l* is shaped to receive the mounting member 46 on the inner sleeve 18 to position the holder 28 on the inner sleeve 18 in the configuration shown in FIG. 1. Similarly, the space between the bracing walls 28*n*, 28*o* is shaped to receive the mounting member 46 on the inner sleeve 18 to position the holder 28 on the inner sleeve 18 in the configuration shown in FIGS. 2–5. In a configuration of the hose-to-wall fitting 12 for use in a built-in vacuum system which utilizes only low-voltage power, the male plug 26 is eliminated and is replaced by an L-shaped closure member (not shown) serving only to provide a smooth external surface.

Certain modifications and variations of the disclosed embodiment of the present invention will be apparent to those skilled in the art. For example, the outer cover 32, the inner sleeve 18 and the holder 28 are preferably formed by molding polycarbonate Class 1 material, but other materials and processes may be used. Similarly, the insulating member 24 of male plug 26 is preferably formed of polyvinyl chloride having an 85 durometer number, but other suitable insulating materials may be used. The low-voltage electrical tab contacts 14, 16 are preferably of aluminum, but other conductive materials may be used. It should be understood that the disclosed embodiment is intended to be illustrative only, and not in any way restrictive of the scope of the invention as defined by the claims set forth hereunder.

We claim:

1. A universal hose-to-wall fitting for a current-carrying flexible hose, comprising:

(a) a generally cylindrical portion for mechanical attachment to one end of a current-carrying flexible hose; and (b) a male end fitting including a first pair of electrical contacts for connection to high-voltage current-carrying elements of a current-carrying flexible hose, and means for rigidly and detachably affixing said male end fitting to said cylindrical portion for orientation of said first pair of electrical contacts:

(i) either toward the wall end of said hose-to-wall fitting so that said first pair of electrical contacts will engage a corresponding pair of high-voltage contacts in a wall fitting virtually simultaneously with the engagement of said cylindrical portion with a source of vacuum;

(ii) or toward the hose end of said hose-to-wall fitting to enable connection of said first pair of electrical contacts to a plug attached to one end of an electrical cord for supplying high-voltage power therethrough.

2. The universal hose-to-wall fitting according to claim 1, wherein said cylindrical portion comprises:

(a) an inner sleeve;

(b) an outer cover surrounding said inner sleeve and having a chamber for said male end fitting formed integrally therein; and (c) means for mechanically affixing said outer cover to said inner sleeve.

3. The universal hose-to-wall fitting according to claim 2, further comprising a second pair of electrical contacts mounted directly on said inner sleeve for connection to low-voltage current-carrying elements of a current-carrying flexible hose.

4. The universal hose-to-wall fitting according to claim 3, wherein said inner sleeve includes two spaced-apart areas of reduced circumference, and said second pair of electrical contacts are a pair of arcuate tabs secured in said spaced-apart areas so as to be flush with the outer surface of the portion of the inner sleeve extending from said outer cover at the wall end of said hose-to-wall fitting.

5. The universal hose-to-wall fitting according to claim 2, wherein said male end fitting comprises:

(a) a plug having said first pair of electrical contacts mounted therein; and (b) a holder in which said plug is mounted, said holder being configured to fit within said chamber in said outer cover.

6. The universal hose-to-wall fitting according to claim 5, wherein said means for detachably affixing said male end fitting to said cylindrical portion comprises a first screw extending through said chamber formed in said outer cover and through said holder to retain said holder in said chamber.

7. The universal hose-to-wall fitting according to claim 5, further comprising a fuse enclosed within said male end fitting.

8. The universal hose-to-wall fitting according to claim 2, wherein said means for mechanically affixing said outer cover to said inner sleeve comprises a second screw extending radially through both said outer cover and said inner sleeve.

9. The universal hose-to-wall fitting according to claim 5, wherein said plug is repositionable in said holder so as to position said first pair of electrical contacts outside of said chamber in said outer cover when said male end fitting is oriented toward the wall end of said hose-to-wall fitting and to position said first pair of electrical contacts within said chamber in said outer cover when said male end fitting is oriented toward the hose end of said hose-to-wall fitting.

10. The universal hose-to-wall fitting according to claim 5, wherein said holder includes a partition to separate said high-voltage current-carrying elements extending therein and connected to said first pair of electrical contacts.

11. The combination of a universal hose-to-wall fitting and a current-carrying flexible hose, comprising:

(a) a length of current-carrying flexible hose; and (b) a universal hose-to-wall fitting comprising:

(1) a generally cylindrical portion mechanically attached to one end of said current-carrying flexible hose; and (2) a male end fitting including a first pair of electrical contacts connected to high-voltage current-carrying elements of said current-carrying flexible hose, and means for rigidly and detachably affixing said male end fitting to said cylindrical portion for orientation of said first pair of electrical contacts:

(i) either toward the wall end of said hose-to-wall fitting so that said first pair of electrical contacts will engage a corresponding pair of high-voltage contacts in a wall fitting virtually simultaneously with the engagement of said cylindrical portion with a source of vacuum;

(ii) or toward the hose end of said hose-to-wall fitting to enable connection of said first pair of electrical contacts to a plug attached to one end of an electrical cord for supplying high-voltage power therethrough.

12. The combination according to claim 11, wherein said cylindrical portion comprises:

(a) an inner sleeve;

(b) an outer cover surrounding said inner sleeve and having a chamber for said male end fitting formed integrally therein; and (c) means for mechanically affixing said outer cover to said inner sleeve.

13. The combination according to claim 12, further comprising a second pair of electrical contacts mounted directly on said inner sleeve and connected to low-voltage current-carrying elements of said current-carrying flexible hose.

14. The combination according to claim 13, wherein said inner sleeve includes two spaced-apart areas of reduced circumference, and said second pair of electrical contacts are a pair of arcuate tabs secured in said spaced-apart areas so as to be flush with the portion of the surface of the inner sleeve extending from said outer cover at the wall end of said hose-to-wall fitting.

15. The combination according to claim 12, wherein said male end fitting comprises:

(a) a plug having said first pair of electrical contacts mounted therein; and (b) a holder in which said plug is mounted, said holder being configured to fit within said chamber in said outer cover.

16. The combination according to claim 15, wherein said means for detachably affixing said male end fitting to said cylindrical portion comprises a first screw extending through said chamber formed in said outer cover and through said holder to retain said holder in said chamber.

17. The combination according to claim 15, further comprising a fuse enclosed within said male end fitting.

18. The combination according to claim 12, wherein said means for mechanically affixing said outer cover to said inner sleeve comprises a second screw extending radially through both said outer cover and said inner sleeve.

19. The combination according to claim 15, wherein said plug is repositionable in said holder so as to position said first pair of electrical contacts outside of said chamber in said outer cover when said male end fitting is oriented toward the wall end of said hose-to-wall fitting, and to position said first pair of electrical contacts within said chamber in said outer cover when said male end fitting is oriented toward the hose end of said hose-to-wall fitting.

20. The combination according to claim 15, wherein said holder includes a partition to separate said high-voltage current-carrying elements extending therein and connected to said first pair of electrical contacts.

* * * * *